US008210993B2

(12) United States Patent
Lee et al.

(10) Patent No.: US 8,210,993 B2
(45) Date of Patent: Jul. 3, 2012

(54) ELLIPTICAL EXERCISE APPARATUS

(75) Inventors: Sunny Lee, Nan-Tou Hsien (TW); Simon Chao, Nan-Tou Hsien (TW)

(73) Assignee: Superweigh Enterprise Co., Ltd. (TW)

( * ) Notice: Subject to any disclaimer, the term of this patent is extended or adjusted under 35 U.S.C. 154(b) by 0 days.

(21) Appl. No.: 12/900,721

(22) Filed: Oct. 8, 2010

(65) Prior Publication Data

US 2012/0088635 A1 Apr. 12, 2012

(51) Int. Cl.
*A63B 22/00* (2006.01)
*A63B 69/16* (2006.01)

(52) U.S. Cl. ..... 482/52; 482/57

(58) Field of Classification Search ..... 482/51, 482/52, 53, 57
See application file for complete search history.

(56) References Cited

U.S. PATENT DOCUMENTS 5,779,599 A * 7/1998 Chen ..... 482/57
6,077,197 A * 6/2000 Stearns et al. ..... 482/52
7,041,036 B1 * 5/2006 Kuo ..... 482/52
7,494,448 B2 * 2/2009 Eschenbach ..... 482/52
7,507,185 B2 * 3/2009 Eschenbach ..... 482/52
7,621,849 B1 * 11/2009 Tsai ..... 482/52
7,682,293 B2 * 3/2010 Eschenbach ..... 482/62
2009/0069158 A1 * 3/2009 Hsu ..... 482/52
2010/0167878 A1 * 7/2010 Grind ..... 482/52

* cited by examiner

*Primary Examiner* — Loan Thanh
*Assistant Examiner* — Daniel F Roland
(74) *Attorney, Agent, or Firm* — Husch Blackwell LLP

(57) ABSTRACT

An elliptical exercise apparatus includes a frame unit having a base frame, two crank arms, and two link units disposed respectively on left and right sides of the frame unit and each including a pedal rod connected pivotally to one of the crank arms. An adjustment unit includes a motor mounted on the frame unit, a threaded rod connected drivenly to the motor, a pull unit connected pivotally to the frame unit and connected drivenly to the threaded rod, and two roller sets connected pivotally to and disposed respectively on left and right sides of the pull unit. Each roller set is disposed in rolling contact with the pedal rod of a respective link unit. The roller sets are limitedly movable toward or away from an axis of rotation of the crank arms by a pulling action of the pull unit.

9 Claims, 10 Drawing Sheets

ELLIPTICAL EXERCISE APPARATUS

BACKGROUND OF THE INVENTION

1. Field of the Invention

The invention relates to an exercise apparatus, and more particularly to an elliptical exercise apparatus.

2. Description of the Related Art

Referring to FIGS. 1 and 2, a conventional elliptical exercise apparatus includes a frame unit 1, a crank wheel unit 2 disposed on the frame unit 1 and having two crank arms 201, and two link units 3 disposed respectively on left and right sides of the frame unit 1. Each link unit 3 includes a pedal rod 301 connected pivotally to one of the crank arms 201, a handle 302 connected pivotally to the frame unit 1, a link rod 303 connected pivotally to a central section of the pedal rod 301 and a bottom end of the handle 302, a support roller 304 connected to the frame unit 1 and in rollable contact with the central section of the pedal rod 301, and a pedal plate 305 disposed on a rear end of the pedal rod 301. Through such a connection, the user's feet can travel along a generally vertically oriented elliptical path during exercise.

However, since the support roller 304 of each link unit 3 is connected to the frame unit 1 at a fixed position, a distance (L) from an axis of rotation of the support roller 304 to an axis of rotation of the crank arms 201 is fixed. This results in the amplitude of upward and downward motion of the pedal plate 305 being also fixed. The size of the elliptical path traveled by the pedal plate 305 is therefore also fixed and cannot be varied. In this case, the user can only exercise the muscle group on his/her lower half body, but not the muscle group on his/her upper half body.

SUMMARY OF THE INVENTION

Therefore, the object of the present invention is to provide an elliptical exercise apparatus that can permit adjustment of the size of an elliptical path traveled by corresponding pedal plates.

According to this invention, an elliptical exercise apparatus comprises a frame unit including a base frame, a crank wheel unit disposed on the frame unit and including two crank arms, two link units disposed respectively on left and right sides of the frame unit, and an adjustment unit. Each link unit includes a pedal rod connected pivotally to one of the crank arms, a pedal plate disposed on a rear end portion of the pedal rod, a handle connected pivotally to the frame unit, and a link rod connected pivotally to the pedal rod and the handle. The adjustment unit includes a motor mounted on the frame unit, a threaded rod connected drivenly to the motor, a pull unit connected pivotally to the frame unit and connected drivenly to the threaded rod, and two roller sets connected pivotally to and disposed respectively on left and right sides of the pull unit. Each roller set is mounted on and disposed in rolling contact with the pedal rod of a respective link unit. The roller sets are limitedly movable toward or away from an axis of rotation of the crank arms by a pulling action of the pull unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
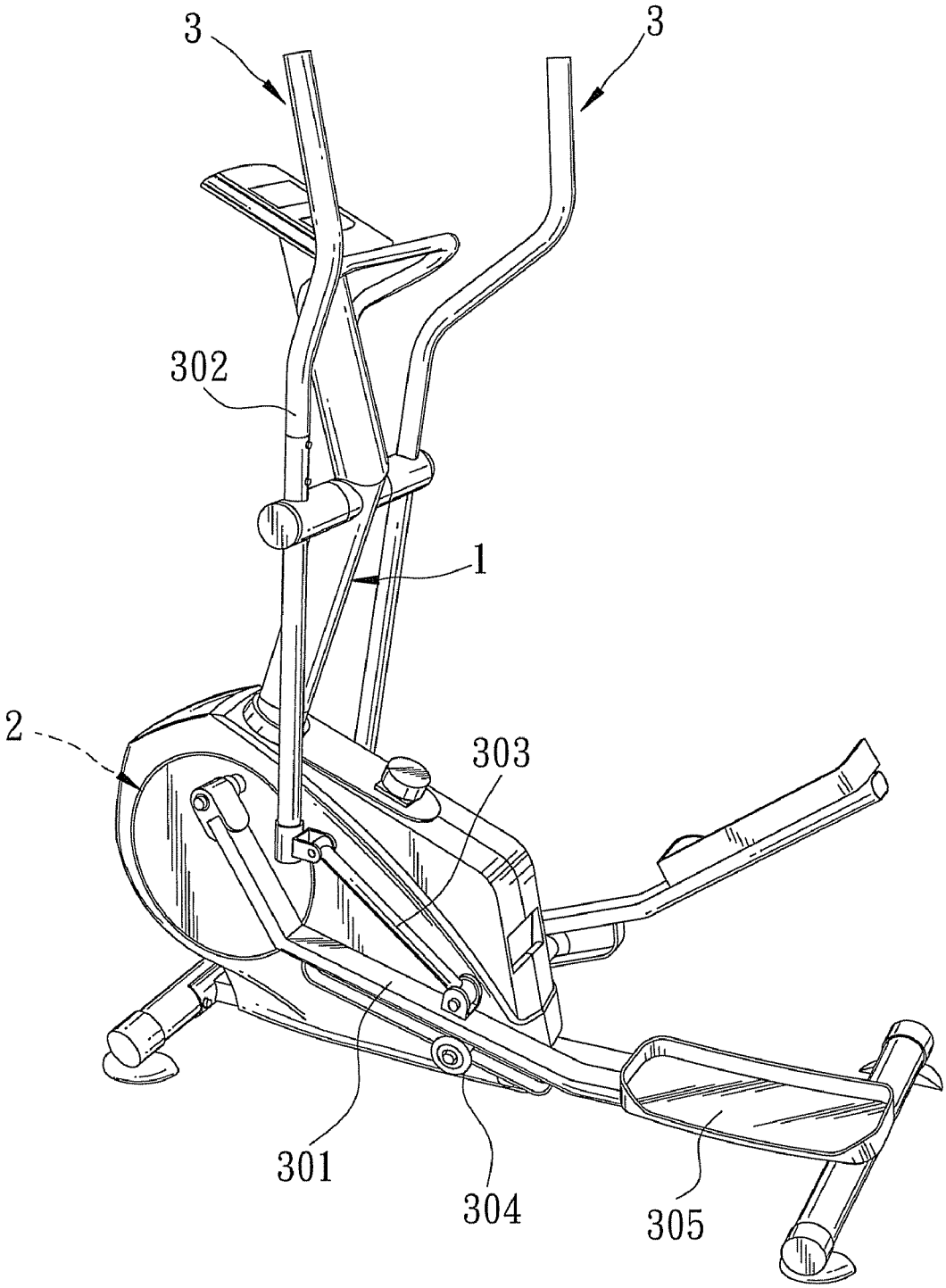
FIG. 1 PRIOR ART
FIG. 1 is a perspective view of a conventional elliptical exercise apparatus.
Figure 2:
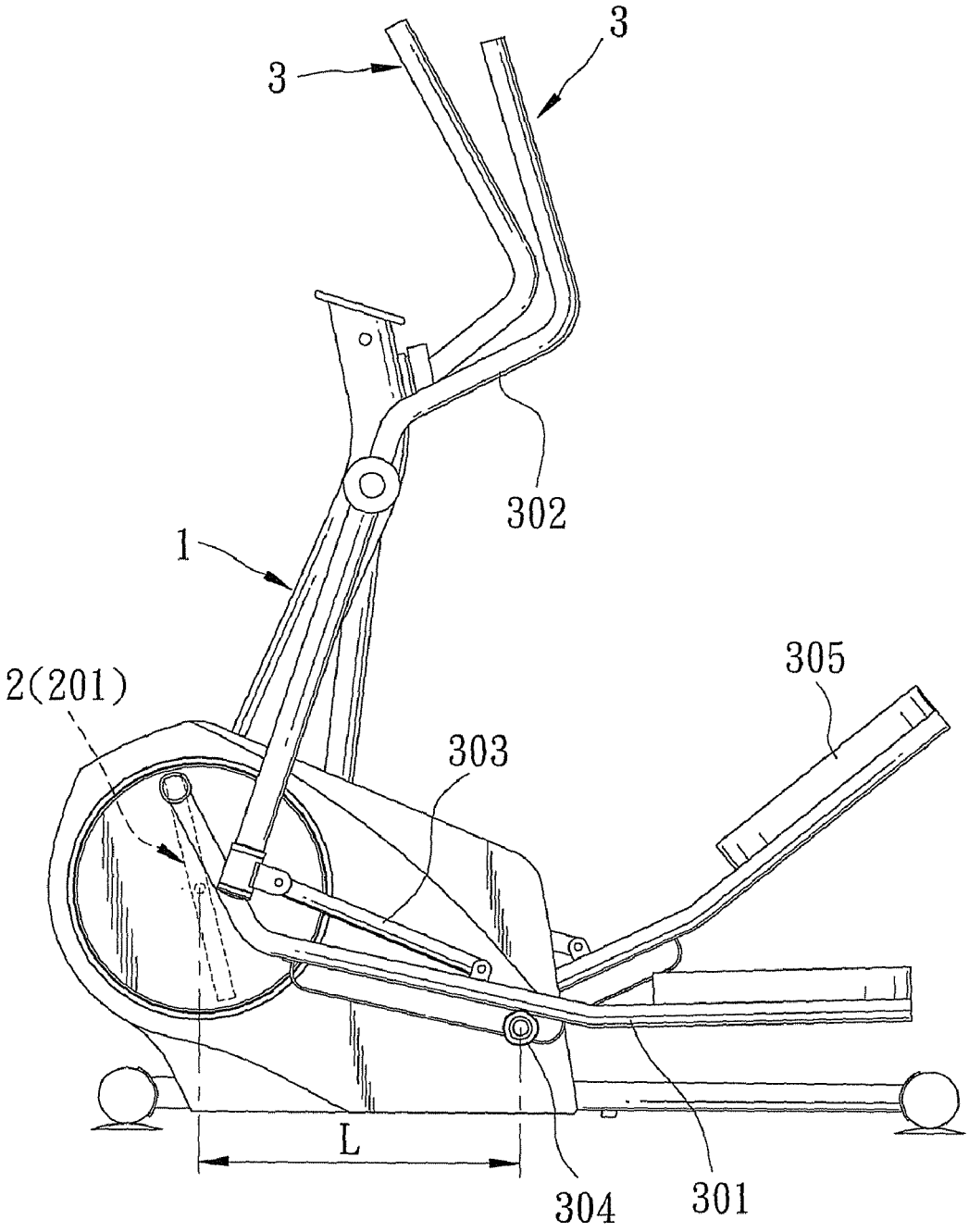
FIG. 2 PRIOR ART
FIG. 2 is a schematic side view of the conventional elliptical exercise apparatus of FIG. 1.
Figure 3:
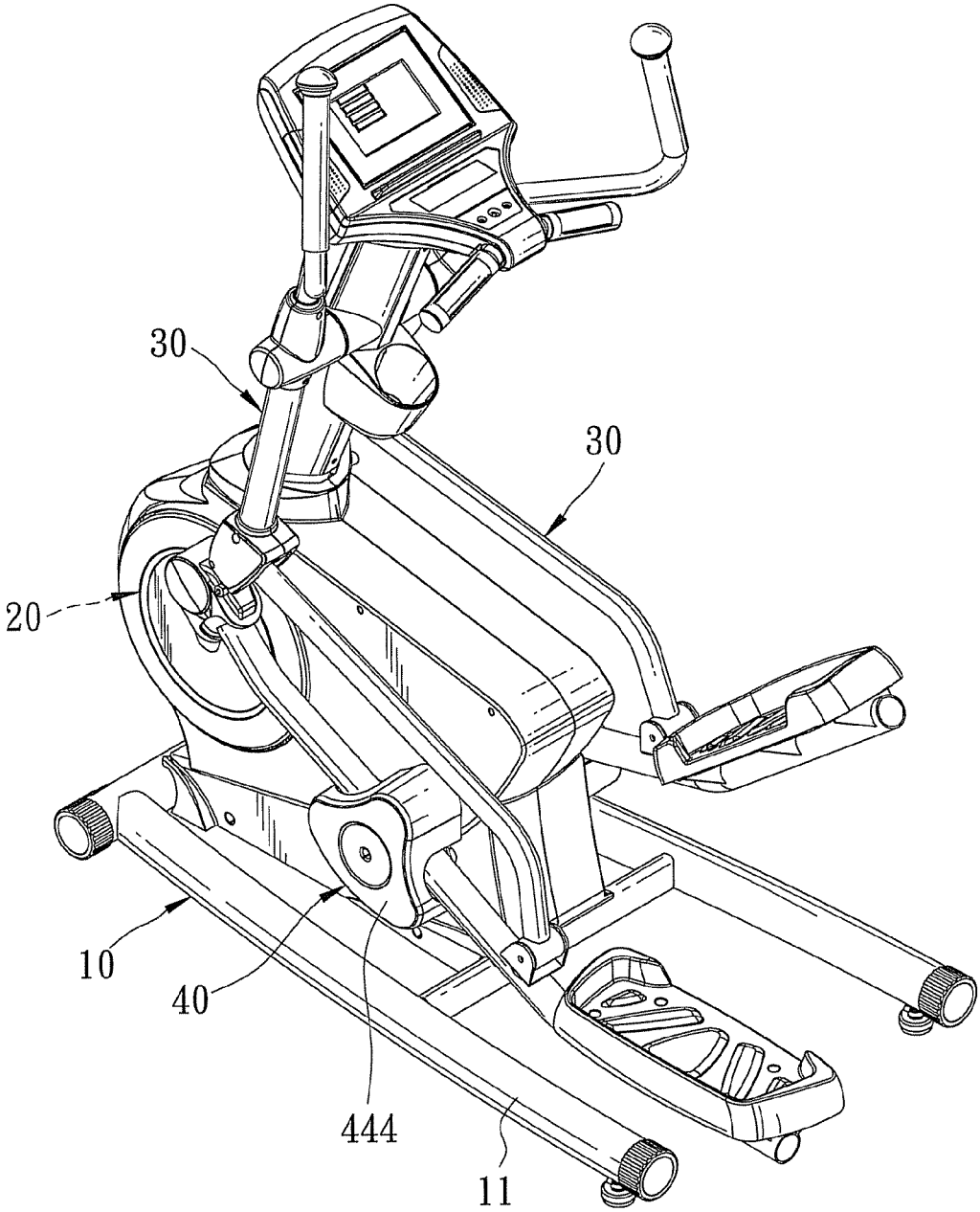
FIG. 3 is a perspective view of an elliptical exercise apparatus according to the preferred embodiment of the present invention.
Figure 4:
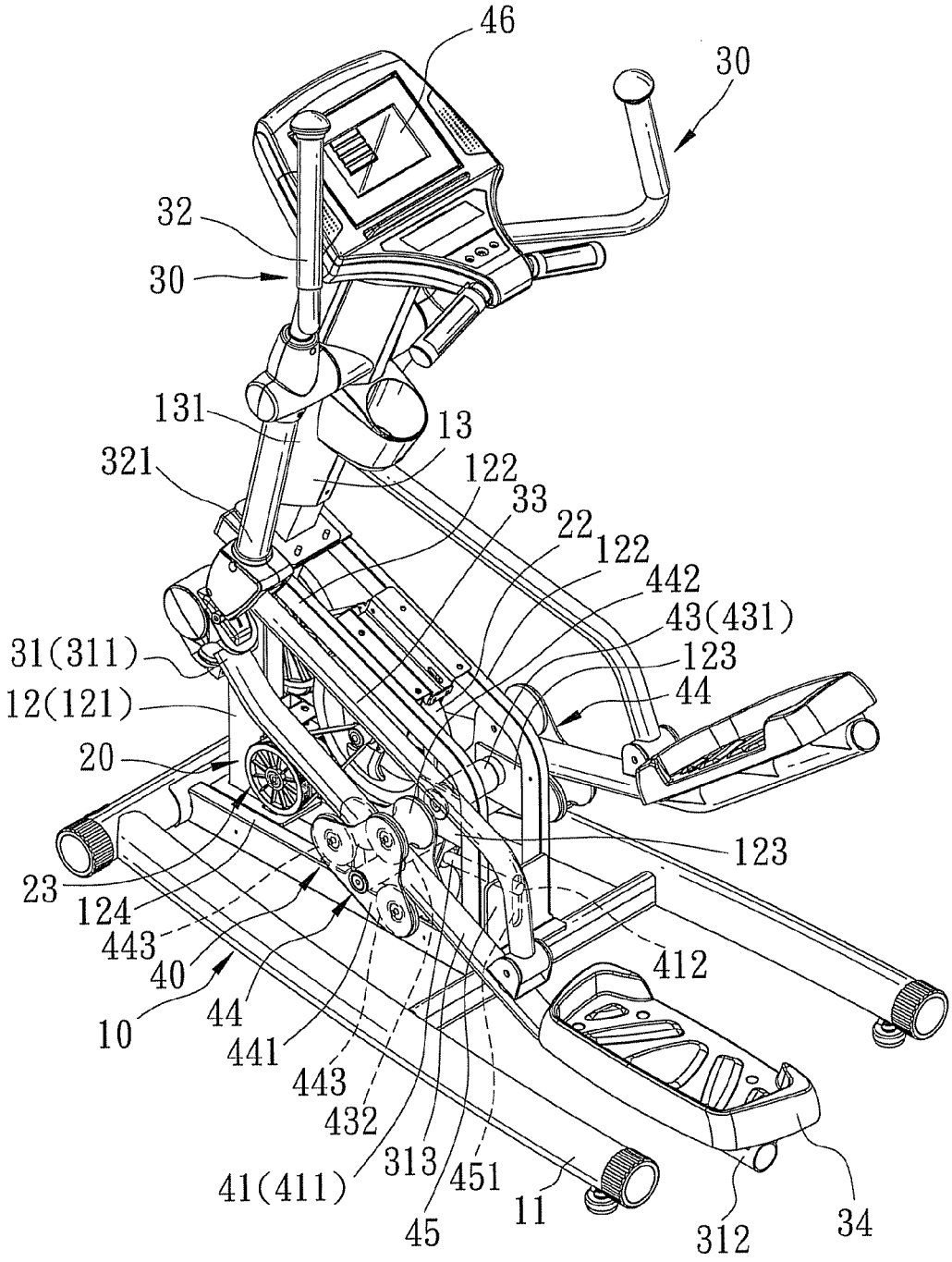
FIG. 4 is a view similar to FIG. 3, but with a housing of the elliptical exercise apparatus and an outer cover of an adjustment unit being removed for clarity's sake.
Figure 5:
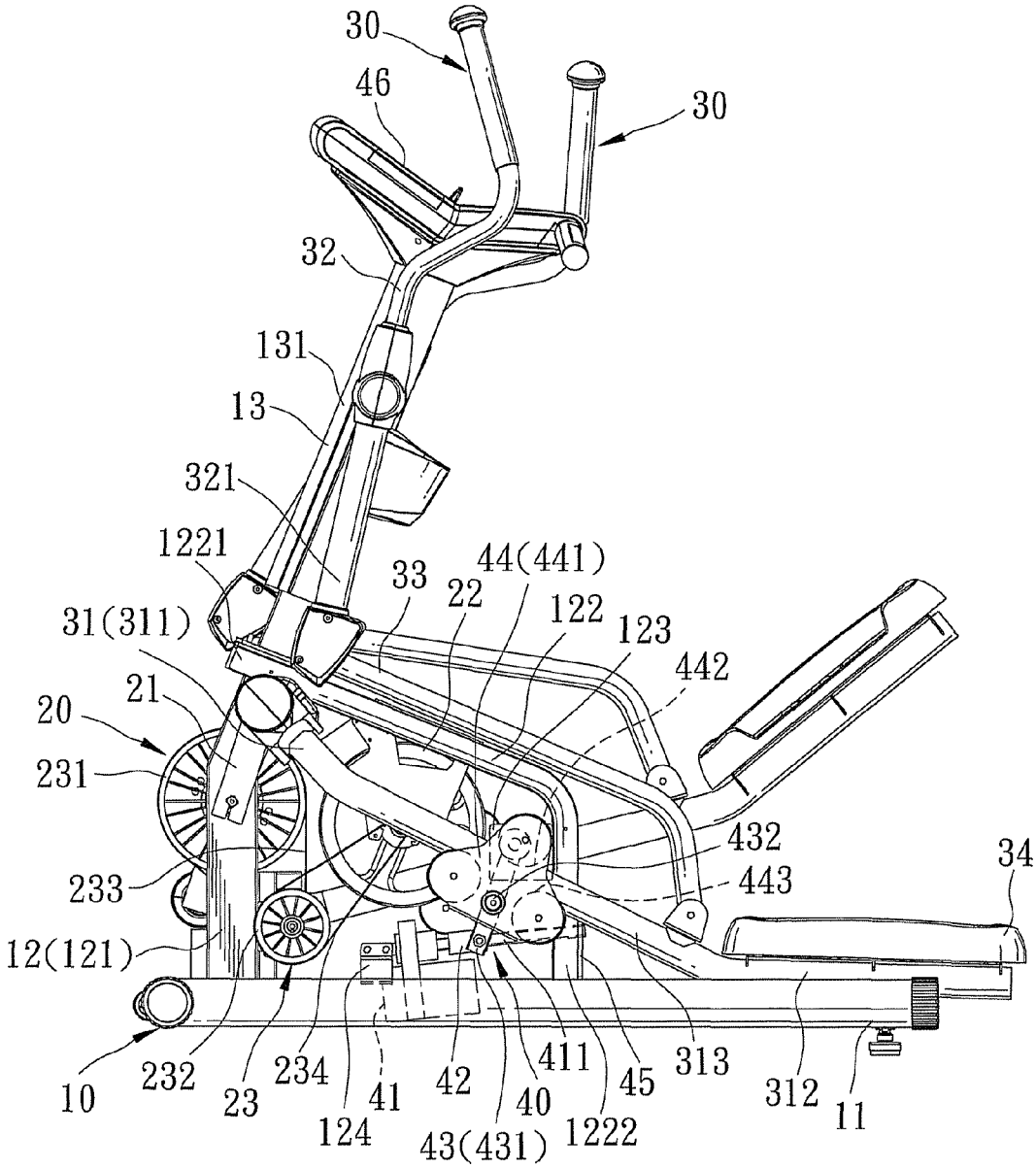
FIG. 5 is a schematic left side view of FIG. 4.
Figure 6:
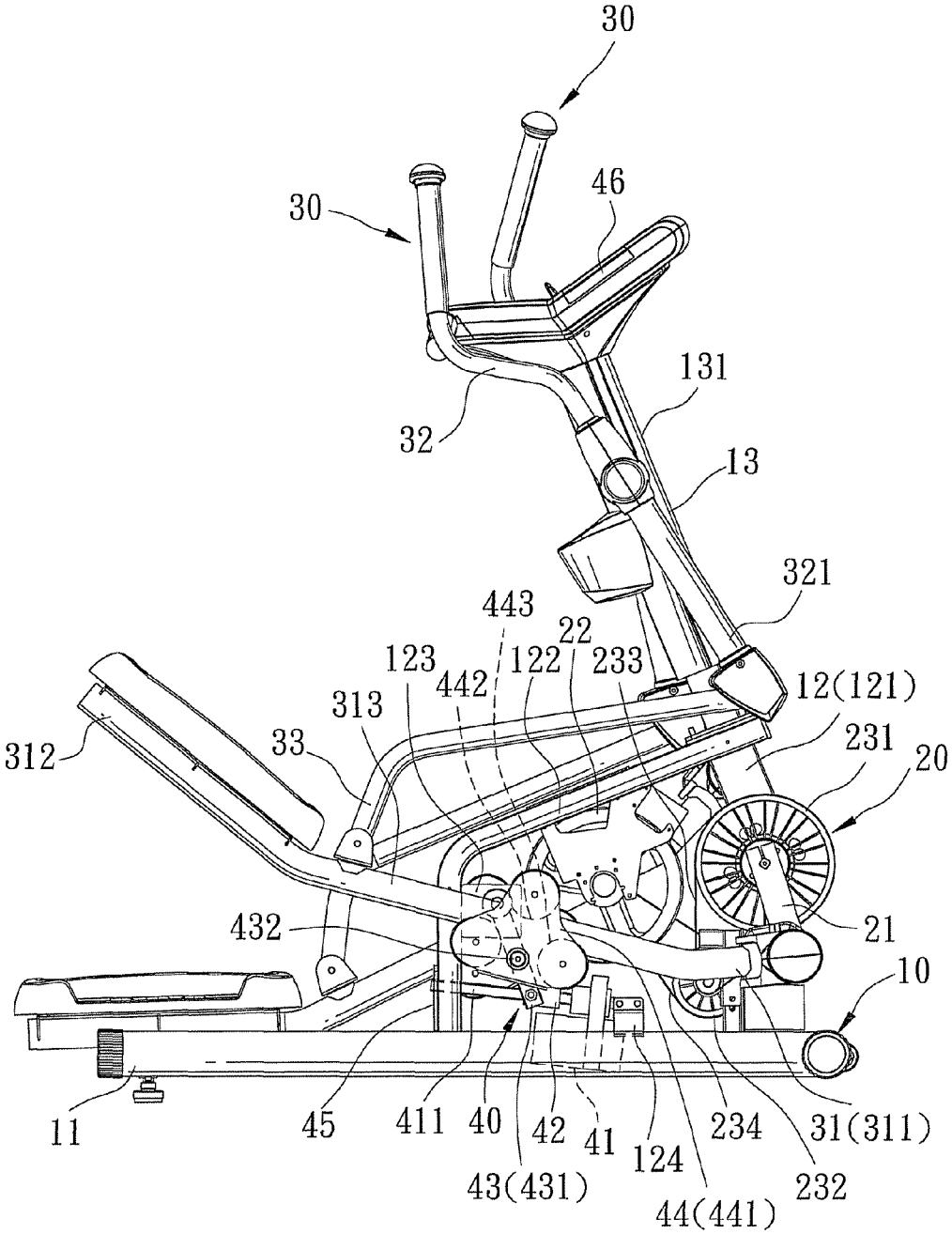
FIG. 6 is a schematic right side view of FIG. 4.
Figure 7:
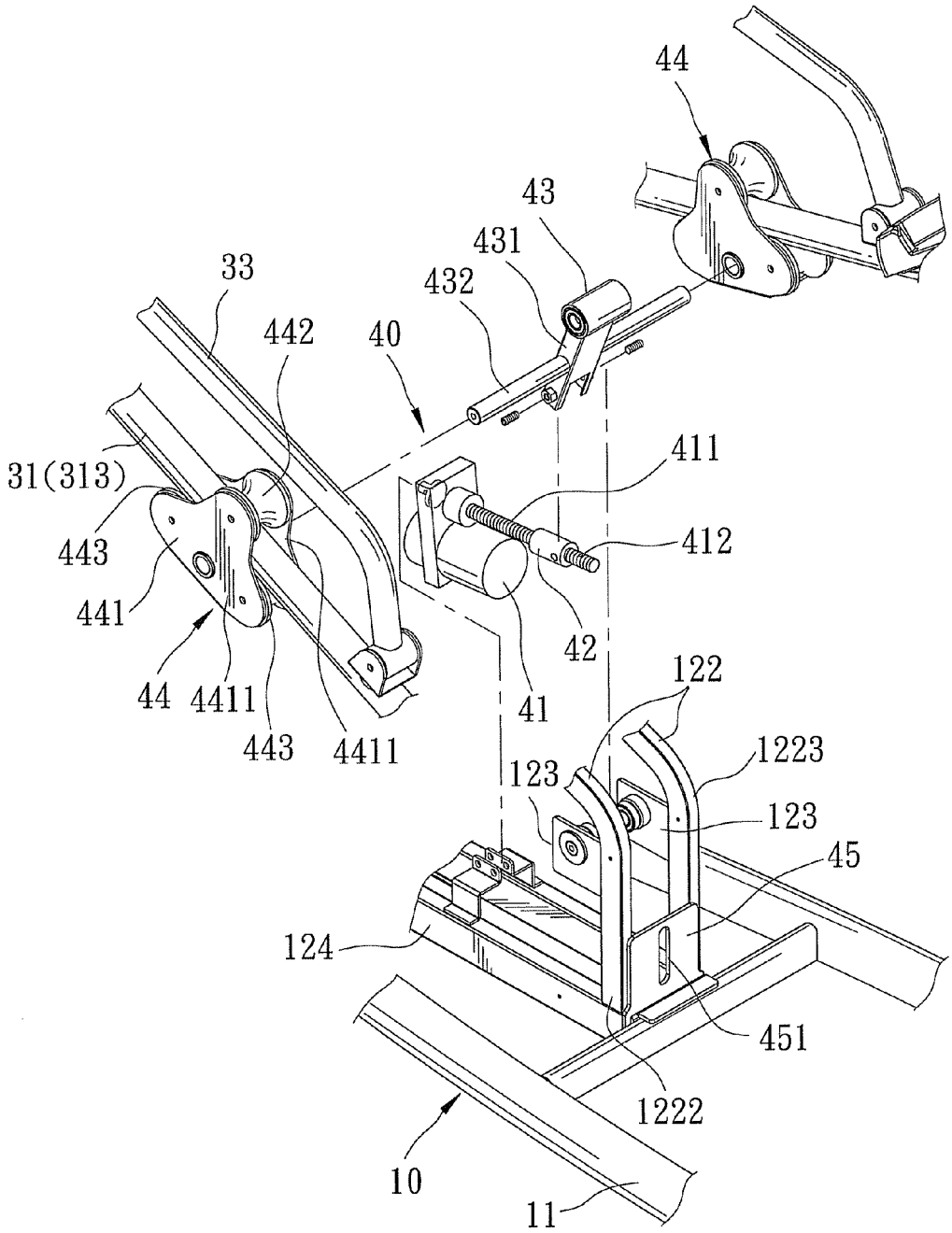
FIG. 7 is a fragmentary exploded perspective view of the preferred embodiment.

Referring to FIGS. 3 to 10, an elliptical exercise apparatus according to the preferred embodiment of the present invention is shown to comprise a frame unit 10, a crank wheel unit 20, two link units 30, and an adjustment unit 40.

The frame unit 10 includes a base frame 11 adapted to be mounted on the ground and that has a bottom support 124. The frame unit 10 also includes an upstanding frame connected to the bottom support 124. The upstanding frame includes a lower frame portion 12 and an upper frame portion 13. The lower frame portion 12 includes a lower upstanding rod 121 extending upward and inclinedly from a front end of the bottom support 124, and two spaced-apart substantially inverted L-shaped rods 122. Each inverted L-shaped rod 122 has a front end 1221 connected to one of the left and right sides of the lower upstanding rod 121 and a bottom end 1222 connected to a rear end of the bottom support 124. The lower frame portion 12 also includes two positioning plates 123 connected respectively to the inverted L-shaped rods 122 in proximity to the bottom ends 1222. The upper frame portion 13 includes an upper upstanding rod 131 connected to and extending upward and inclinedly from the lower upstanding rod 121.

The crank wheel unit 20 is disposed on the lower frame portion 12, and includes a crank wheel 231 mounted rotatably on the lower upstanding rod 121, and two crank arms 21 connected coaxially, rotatably, and respectively to left and right sides of a crank shaft of the crank wheel 231.

A resisting unit 22 and a drive mechanism 23 are provided on the lower frame portion 12. The resisting unit 22 includes a resistance wheel 22 mounted rotatably on the lower frame portion 12 between the inverted L-shaped rods 122 and rearward of the crank wheel 231. The drive mechanism 23 is disposed on the lower frame portion 12 between the resistance wheel 22 and the crank wheel 231, and includes a belt pulley 232 disposed below the crank wheel 231, a first belt 233 interconnecting the crank wheel 231 and the belt pulley 232, and a second belt 234 interconnecting the belt pulley 232 and the resistance wheel 22. The resistance wheel 22 is driven by the crank arms 21 to rotate through the drive mechanism 23.

The link units 30 are disposed respectively on left and right sides of the frame unit 10. Each link unit 30 includes a pedal rod 31, a handle 32, a link rod 33, and a pedal plate 34. The pedal rod 31 has a front end portion 311 connected pivotally to one of the crank arms 21, a rear end portion 312, and an intermediate portion 313 between the front and rear end portions 311, 312. The handle 32 is connected pivotally to the upper upstanding rod 131, and has a bottom end portion 321. The link rod 33 has two opposite ends connected pivotally and respectively to the bottom end portion 321 of the handle 32 and the intermediate portion 313 of the pedal rod 31. The pedal plate 34 is disposed on the rear end portion 312 of the pedal rod 31.

The adjustment unit 40 includes a motor 41 mounted on the bottom support 124, a threaded rod 411 connected to and driven by the motor 41, a pull unit 43, two roller sets 44, a limiting plate 45, and a console panel 46. The pull unit 43 includes a pivot arm 431 having a top end connected pivotally to and disposed between the positioning plates 123 and a bottom end opposite to the top end, a horizontal pull rod 432 extending transversely through the pivot arm 431 between the top and bottom ends thereof, and a sleeve member 42 attached to the bottom end of the pivot arm 431 and sleeved threadedly around the threaded rod 411.

Each roller set 44 includes a roller support 441 connected pivotally to one of the left and right ends of the horizontal pull rod 432 and having two spaced-apart support plates 4411, a limiting roller 442 connected between the support plates 4411, two supporting rollers 443 connected between the support plates 4411 and spaced apart from each other and from the limiting roller 442, and an outer cover 444 (see FIG. 3) to cover the support plates 4411 and the limiting and supporting rollers 442, 443. In this embodiment, the limiting roller 442 is disposed above the two supporting rollers 443, and the limiting roller 442 and the supporting rollers 443 are arranged in a triangular fashion within the support plates 4411.

The limiting plate 45 is connected to rear ends 1223 of the inverted L-shaped rods 122 rearward of the motor 41. The limiting plate 45 has a limiting hole 451 extending in a top-bottom direction. A rear end 412 of the threaded rod 411 extends into the limiting hole 451. The console panel 46 is provided on a top end of the upper upstanding rod 131, and is connected electrically to the motor 41.

The intermediate portion 313 of the pedal rod 31 extends through one of the roller sets 44 between the limiting roller 442 and the supporting rollers 443 such that each roller set 44 is mounted on and is disposed in rolling contact with the pedal rod 31 of the respective link unit 30. The motor 41 can actuate the threaded rod 411 to rotate so that the sleeve member 42 can move threadedly forward or rearward along the length of the threaded rod 411. The sleeve member 42, in turn, moves the pivot arm 431 along the threaded rod 411. The pivot arm 431, in turn, pulls the roller sets 44 to move limitedly along the intermediate portions 313 of the pedal rods 31 of the respective link units 30 toward or away from an axis of rotation 211 of the crank arms 21.

When a user steps on the pedal plates 34 of the link units 30 and pulls the handles 32 of the link units 30 reciprocatingly to perform an exercise, the pedal plates are moved along a generally vertically oriented elliptical path, so that the user's feet also travel along a generally vertically oriented elliptical path.

Figure 8:
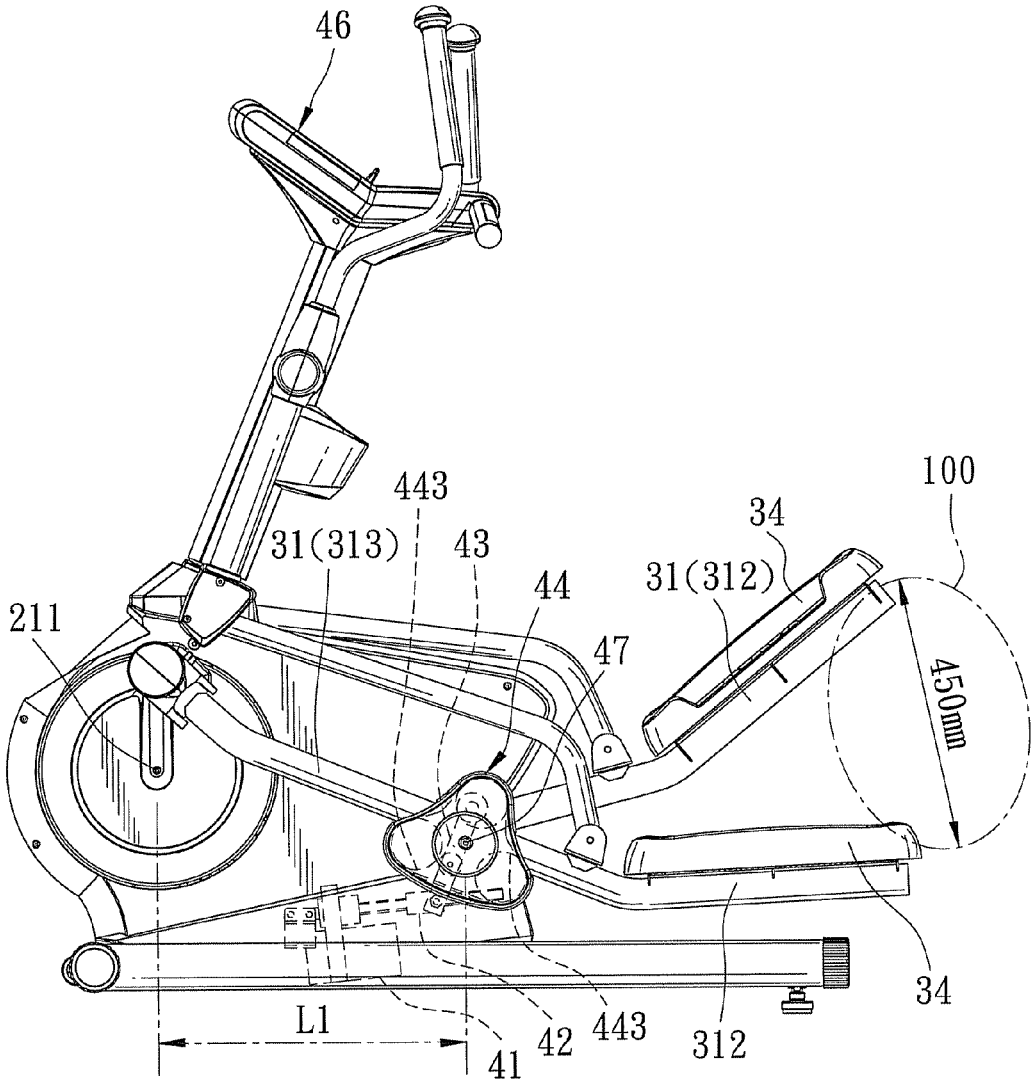
FIG. 8 is a schematic side view of the preferred embodiment, illustrating a pedal plate traveling along a smallest vertically oriented elliptical path.
Figure 9:
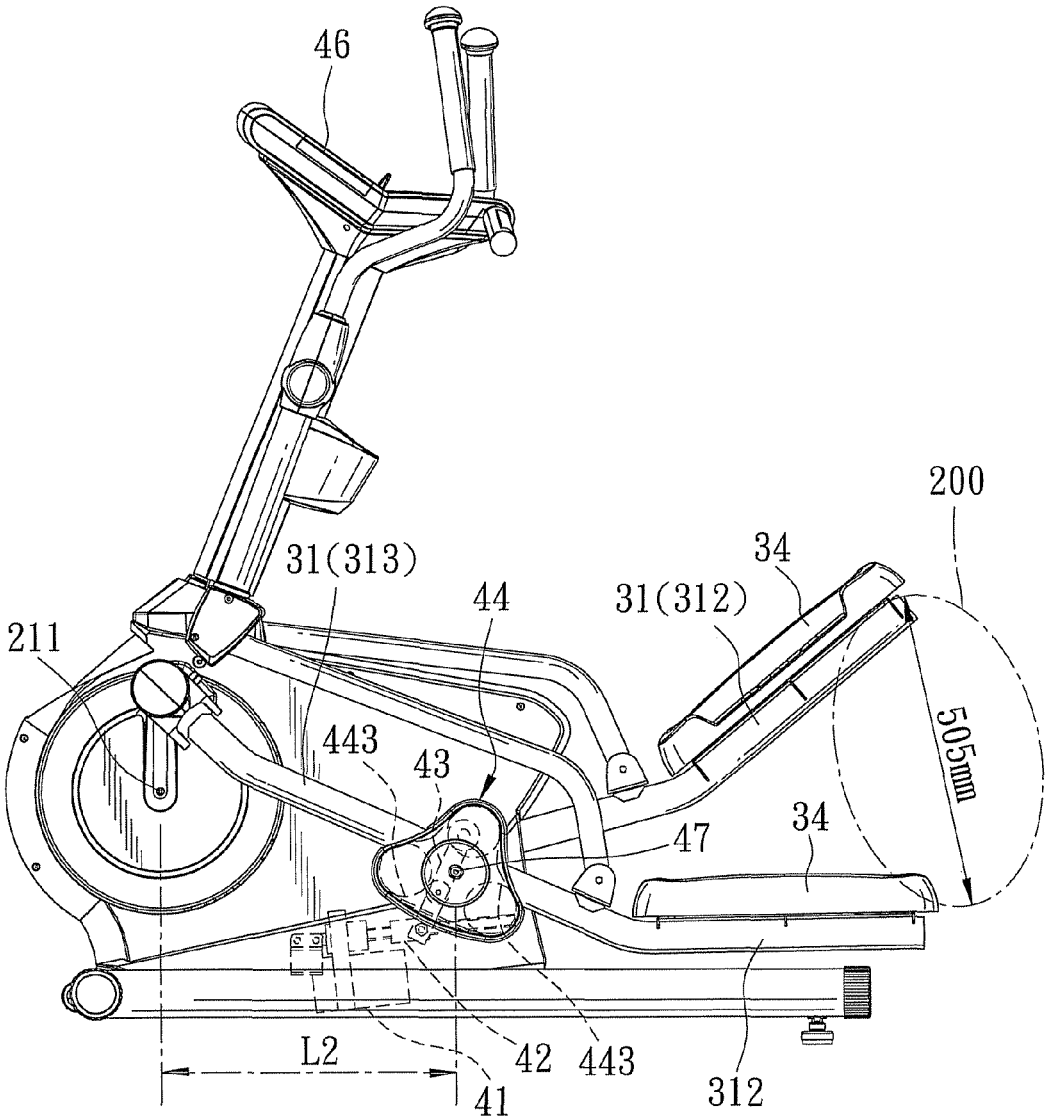
FIG. 9 is a view similar to FIG. 8, but illustrating the pedal plate traveling along a vertically oriented elliptical path that is larger than that shown in FIG. 8.
Figure 10:
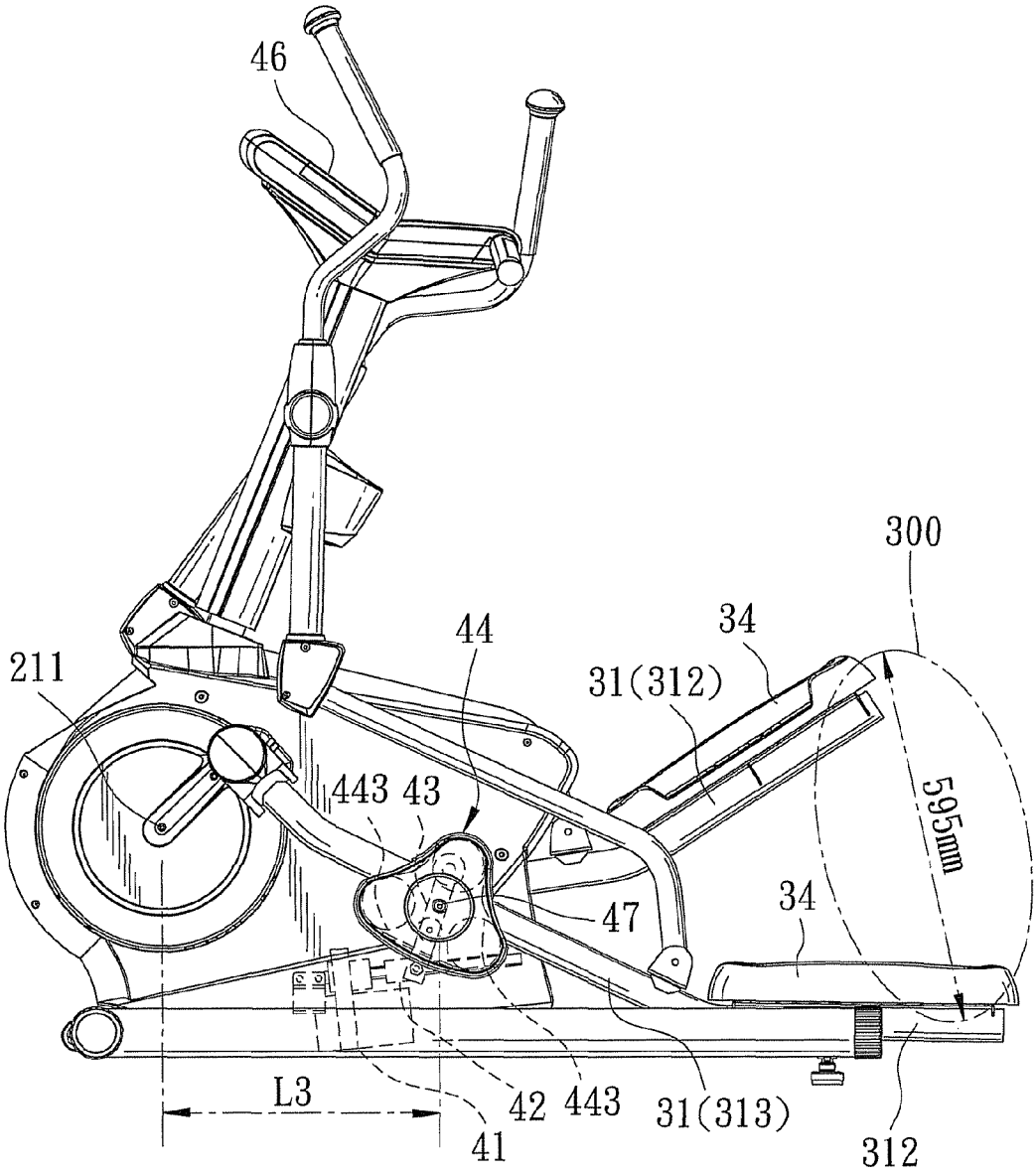
FIG. 10 is a view similar to FIG. 9, but illustrating the pedal plate traveling along a largest vertically oriented elliptical path.

With reference to FIGS. 8 to 10, the user can control the motor 41 through the console panel 46 to actuate the sleeve member 42 to move the pull unit 43 forward or rearward so that the pull unit 43 can pull the roller sets 44 to move slidably and respectively along the intermediate portions 313 of the pedal rods 31 of the link units 30. As such, different distances (L1, L2, L3) can be defined between an axis of symmetry 47 of each roller set 44 and the axis of rotation 211 of the crank arms 21. In this embodiment, the distance (L1) is 499 mm, the distance (L2) is smaller than the distance (L1) and is 466 mm, and the distance (L3) is smaller than the distance (L2) and is 433 mm.

As shown in FIG. 8, since the distance (L1) is the largest, in contrast, the moment arm from the rear end portion 312 of the pedal rod 31 to the axis of symmetry 47 of the respective roller set 44 is the smallest. As such, the amplitude of upward and downward motion of the pedal plates 34, which move along with the respective pedal rods 31, relative to the respective roller sets 44 will be the smallest. Hence, the size of a vertically oriented elliptical path 100 traveled by the pedal plates 34 is also the smallest with a major axis diameter of 450 mm.

As shown in FIG. 9, since the distance (L2) is smaller than that of the distance (L1), in contrast, the moment arm from the rear end portion 312 of the pedal rod 31 to the axis of symmetry 47 of the respective roller set 44 is larger than that described in FIG. 8. As such, the amplitude of the upward and downward motion of the pedal plates 34 relative to the respective roller sets 44 will also be larger than the amplitude described in FIG. 8. Hence, the size of a vertically oriented elliptical path 200 traveled by the pedal plates 34 is larger than that of the elliptical path 100, and has a major axis diameter of 505 mm.

As shown in FIG. 10, since the distance (L3) is the smallest, in contrast, the moment arm from the rear end portion 312 of the pedal rod 31 to the axis of symmetry 47 of the respective roller set 44 is the largest. As such, the amplitude of the upward and downward motion of the pedal plates 34 relative to the respective roller set 44 will be the largest. Hence, the size of a vertically oriented elliptical path 300 traveled by the pedal plates 34 is the largest as compared to that of the elliptical paths 100 and 200, and has a major axis diameter of 595 mm.

Hence, by varying the size of the elliptical paths traveled by the pedal plates 34, the user can exercise different muscle groups of his/her body during exercise. For example, the size of the elliptical path 100 of FIG. 8 is the smallest, which permits the user to focus on exercising the muscle groups of his/her lower half body. In contrast, the size of the elliptical path 300 of FIG. 10 is the largest, which permits the user to exercise not only the muscle groups of his/her lower half body, but also the muscle groups of his/her upper half body.

From the aforesaid description, the advantage of the preferred embodiment resides in the fact that because the adjustment unit 40 of the present invention can urge each roller set 44 to move slidably along the pedal rod 31 of the respective link unit 30, the user may adjust the distance of each roller set 44 relative to the respective crank arm 21 to suit his/her exercise requirement, so that the pedal rods 31 can move the pedal plates 34 therealong to travel along a generally vertically oriented elliptical path of different sizes. Hence, by varying the size of the elliptical path traveled by the pedal plates 34, the user can train different muscle groups of his/her body during exercise. Hence, the object of the present invention can be realized.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. An elliptical exercise apparatus comprising:

a frame unit including a base frame;

a crank wheel unit disposed on said frame unit and including two crank arms;

two link units disposed respectively on left and right sides of said frame unit, each of said link units including a pedal rod connected pivotally to one of said crank arms, a pedal plate disposed on a rear end portion of said pedal rod, a handle connected pivotally to said frame unit, and a link rod connected pivotally to said pedal rod and said handle; and an adjustment unit including a motor mounted on said frame unit, a threaded rod connected drivenly to said motor, a pull unit connected pivotally to said frame unit and connected drivenly to said threaded rod, and two roller sets connected pivotally to and disposed respectively on left and right sides of said pull unit, each of said roller sets being mounted on and being disposed in rolling contact with said pedal rod of a respective one of said link units, said roller sets being limitedly movable toward or away from an axis of rotation of said crank arms by a pulling action of said pull unit;

wherein each of said roller sets includes a roller support connected pivotally to one of said left and right sides of said pull unit, at least one supporting roller connected to said roller support, and a limiting roller connected to said roller support and spaced apart from said supporting roller, said pedal rod of each of said link units extending through one of said roller sets between said supporting roller and said limiting roller;

wherein said pedal rod has a front end portion opposite to said rear end portion and connected pivotally to one of said crank arms, and an intermediate portion between said front and rear end portions, said handle having a bottom end portion, said link rod having two opposite ends connected pivotally and respectively to said bottom end portion of said handle and said intermediate portion of said pedal rod, said intermediate portion of said pedal rod extending through the respective one of said roller sets between said supporting roller and said limiting roller.

2. The elliptical exercise apparatus of claim 1, wherein said roller support includes two spaced-apart support plates, said supporting roller and said limiting roller being connected between said support plates.

3. The elliptical exercise apparatus of claim 2, wherein each of said roller sets includes two said supporting rollers that are spaced apart from each other and from said limiting roller, said supporting rollers and said limiting roller being arranged in a triangular fashion within said support plates.

4. The elliptical exercise apparatus of claim 2, wherein each of said roller sets further includes an outer cover to cover said support plates and said supporting and limiting rollers.

5. An elliptical exercise apparatus comprising:

a frame unit including a base frame;

a crank wheel unit disposed on said frame unit and including two crank arms;

two link units disposed respectively on left and right sides of said frame unit, each of said link units including a pedal rod connected pivotally to one of said crank arms, a pedal plate disposed on a rear end portion of said pedal rod, a handle connected pivotally to said frame unit, and a link rod connected pivotally to said pedal rod and said handle; and an adjustment unit including a motor mounted on said frame unit, a threaded rod connected drivenly to said motor, a pull unit connected pivotally to said frame unit and connected drivenly to said threaded rod, and two roller sets connected pivotally to and disposed respectively on left and right sides of said pull unit, each of said roller sets being mounted on and being disposed in rolling contact with said pedal rod of a respective one of said link units, said roller sets being limitedly movable toward or away from an axis of rotation of said crank arms by a pulling action of said pull unit;

wherein said frame unit includes said base frame and an upstanding frame extending uprightly from said base frame;

wherein said pull unit includes a pivot arm having a top end pivoted to said upstanding frame and a bottom end, a horizontal pull rod extending transversely through said pivot arm between said top and bottom ends of said pivot arm, and a sleeve member attached to said bottom end of said pivot arm and sleeved threadedly around said threaded rod, said horizontal pull rod having left and right ends connected pivotally and respectively to said roller sets.

6. The elliptical exercise apparatus of claim 5, wherein said upstanding frame includes a lower frame portion connected to said base frame and having a lower upstanding rod extending upwardly from a front end of said base frame, and an upper frame portion having an upper upstanding rod connected to and extending upwardly and inclinedly from said lower upstanding rod, said crank wheel unit including a crank wheel mounted on said lower frame portion, said crank arms being connected coaxially and rotatably to said crank wheel, said handles of said link units being connected pivotally and respectively to left and right sides of said upper upstanding rod, said motor and said pull unit being disposed on said lower frame portion.

7. The elliptical exercise apparatus of claim 6, wherein said adjustment unit further includes a limiting plate connected to said lower frame portion rearwardly of said motor and having a limiting hole extending in a top-bottom direction, said threaded rod having a rear end extending into said limiting hole.

8. The elliptical exercise apparatus of claim 6, further comprising a resisting unit and a drive mechanism, said resisting unit includes a resistance wheel disposed on said lower frame portion, said drive mechanism being disposed on said lower frame portion between said resistance wheel and said crank wheel, said resistance wheel being driven by said crank arms to rotate through said drive mechanism.

9. The elliptical exercise apparatus of claim 6, wherein said adjustment unit further includes a console panel provided on a top end of said upper upstanding rod and connected electrically to said motor.

* * * * *